US007073799B2

(12) United States Patent
Gorisch

(10) Patent No.: US 7,073,799 B2
(45) Date of Patent: Jul. 11, 2006

(54) ASYMMETRICALLY STEERING ROLLING DEVICE

(76) Inventor: Wolfram Gorisch, Dueppeler Str. 20, D-81929 Muenchen (DE)

( * ) Notice: Subject to any disclaimer, the term of this patent is extended or adjusted under 35 U.S.C. 154(b) by 45 days.

(21) Appl. No.: 10/779,406

(22) Filed: Feb. 17, 2004

(65) Prior Publication Data

US 2004/0164506 A1 Aug. 26, 2004

(51) Int. Cl.
*A63C 17/00* (2006.01)

(52) U.S. Cl. ..... 280/11.27; 280/11.28; 280/11.223; 280/87.041; 280/87.042; 280/267; 280/11.19

(58) Field of Classification Search ..... 280/11.27, 280/11.28, 87.041, 87.042
See application file for complete search history.

(56) References Cited

U.S. PATENT DOCUMENTS

| | | | | |
|---|---|---|---|---|
| 4,133,546 | A * | 1/1979 | Rosenblum | 280/842 |
| 4,817,974 | A * | 4/1989 | Bergeron | 280/11.209 |
| 6,398,229 | B1 * | 6/2002 | Saylor | 280/11.19 |
| 6,755,425 | B1 * | 6/2004 | Gorisch | 280/11.27 |

* cited by examiner

*Primary Examiner*—Christopher P. Ellis
*Assistant Examiner*—Cynthia F. Collado

(57) ABSTRACT

The two skates steered by leaning sideways normally curve along circles of similar curvature. As the two circles are offset by the legs' distance they intersect. In order to avoid this disadvantage it is desirable that the outer leg's curved track has a larger radius than the inner leg's curved track. Using lean-controlled steered skates with tiltable wheels comprising a parallelogram closed fourbar linkage including two horizontal cross-guides the purpose is achieved by affixing the two cross-guides rotatably to extensions of the frame in such a way that the vertical projection of the rotation axis makes a solid angle with the vertical projection of the pivot axes of the closed fourbar linkage.

1 Claim, 1 Drawing Sheet

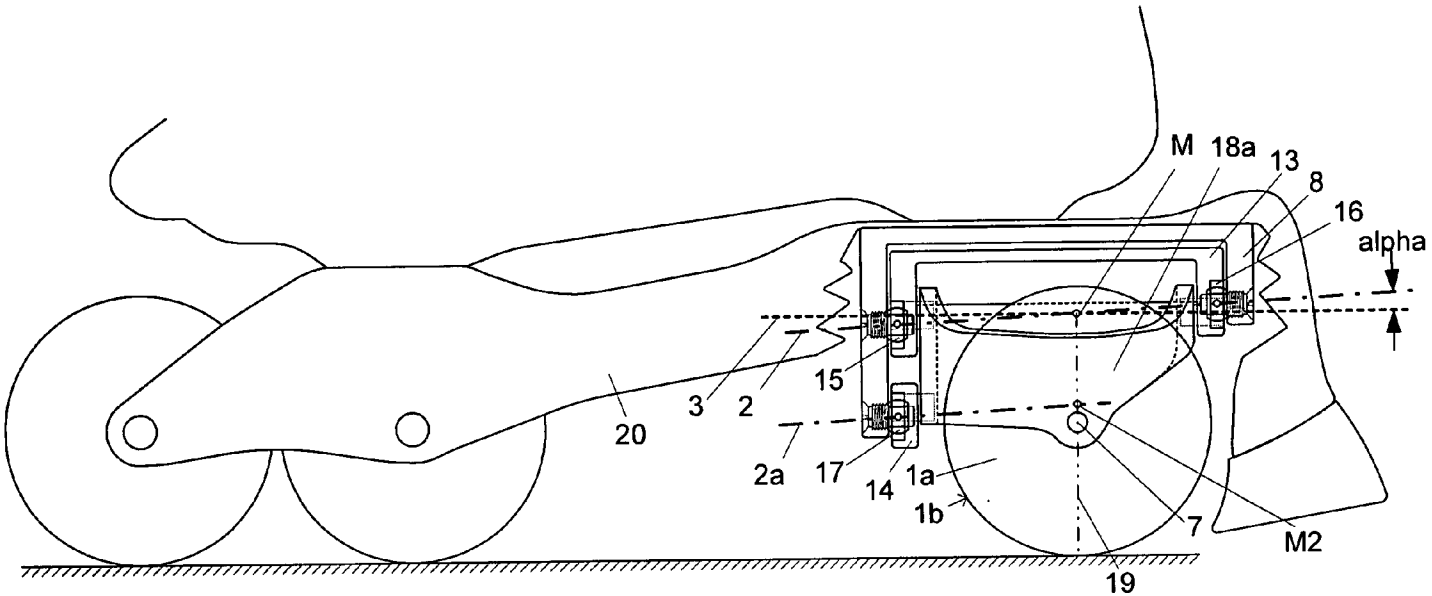
Fig. 1 (state of the art)
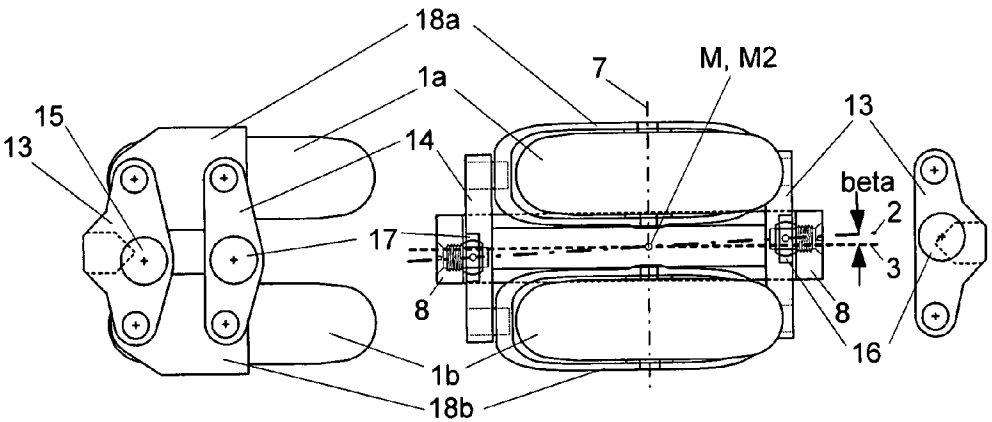
Fig. 2

ASYMMETRICALLY STEERING ROLLING DEVICE

BACKGROUND OF THE INVENTION

This invention relates to steered rolling devices, for example roller skates, multi tracked skates, skis on wheels.

As far as the mentioned rolling devices are to be steered by leaning sideways they steer the same way on either side. The state of the art is for example shown by US6,755,425 or EP1213043B1, which disclose a steering mechanism containing two wheels guided by a laterally oriented closed parallelogram or trapezium fourbar linkage. FIG. 1 shows the state-of-the-art steering mechanism. Part of the frame 20 is cut away so that the steering mechanism can be seen. FIG. 1 shows horizontal cross-guides 13, 14, which are rotatably secured to extensions 8 of the frame 20, the axes of rotation being 2 and 2*a*. In order to provide the rotation around axis 2 two spherical bushings 15, 16 are used; in order to provide rotation around axis 2*a* one spherical bushing 17 is used. The contour of the boot is indicated.

A pair of rolling devices is attached to the two legs of the skater. Upon slaloming, in particular when skating along a circle, both legs perform tracks with equal curvature, which are offset by the legs' distance. Hence one track crosses the other so that parallel skating is disturbed eventually causing the skater to fall down and suffer injury. This interference can be avoided by using technical means, which let the outer skate perform a wider curve than the inner skate.

DE10135481A1 discloses one solution to the problem insofar as two fixed wheels oriented one behind the other providing a lateral offset so that upon leaning to one side the first wheel has contact to the ground, upon leaning to the other side, the second wheel has contact to the ground. Hence turning left provides a wheel-base which is different from the wheel-base when turning right providing the desired difference between the left curve radius and the right curve radius. However this solution is disadvantageous, as when turning left or right either the one or the other wheel lifts from the ground which results in a bad tracking behavior. Furthermore the wheels suffer from asymmetric wear. Therefore it is desirable that the asymmetric steering is intrinsically provided by the steering mechanism itself.

BRIEF SUMMARY OF THE INVENTION

The purpose of the invention therefore is to design the steering mechanism in a way that the steering effect generated by the sideways leaning to the left is different from the steering to the right.

Based on the known rolling device to be used on the ground which is symmetrically steered by leaning sideways, consisting of an upper boot, a frame attached to the upper boot and at least one steering mechanism, the steering mechanism consisting of one pair of wheels oriented side by side, wherein the two wheels are rotatably affixed to two wheel holders and wherein the two wheel holders are pivotably interconnected using an upper horizontal cross-guide and a lower horizontal cross-guide so that a parallelogram or trapezium-like closed fourbar linkage results, wherein the two horizontal cross-guides are rotatably affixed each to the frame, wherein the direction of the rotation axes makes a solid angle alpha with the direction of the pivot axes of the closed fourbar linkage, wherein the two cross-guides and the frame have bore-holes which accommodate axles, bearings or spherical bushings allowing rotation around the said rotation axes, the purpose of the invention is achieved by the said bore-holes being positioned so that the vertical projection of the said rotation axes onto the ground each make a solid angle beta beyond zero to the vertical projection of the pivot axes of the closed fourbar linkage onto the ground.

BRIEF DESCRIPTION OF THE SEVERAL VIEWS OF THE DRAWINGS

FIG. 1 shows a side view of a skate including the state-of-the-art steering mechanism, showing the lateral projection of axis 2 which is at an acute angle alpha with respect to the middle line 3 which is parallel to the four pivot axes of the closed fourbar linkage.

FIG. 2 shows details of the invented asymmetrically steering mechanism as seen from the bottom, disclosing the solid angle beta extending between the vertical projection of axis 2 and the vertical projection of the middle line which is assumed here to be parallel to the four pivot axes of the closed fourbar linkage, the middle line appearing projected as the line 3 in FIG. 2(*b*). FIG. 2(*a*) shows the steering mechanism as seen from the front, omitting one extension 8. FIG. 2(*c*) shows the upper cross-guide 13 as seen from behind.

DETAILED DESCRIPTION OF THE INVENTION

In particular it is shown (FIG. 2(*b*)) that the spherical bushings 15, 16 from the upper horizontal cross-guide 13 are located diagonally off-center with respect to the middle. It can also be seen that the spherical bushing 17 from the lower cross-guide is located off-center with respect to the middle. Spherical bushings need not necessarily be used. A person familiar with the art may use other technical means like axle bore-holes and axles or the like in order to provide the cross-guides with the capability of rotation with respect to the extensions 8 of the frame, given that the axis of rotation has the position and the direction as disclosed in this invention.

It is desirable that the two wheels 1*a*, 1*b* carry equal loads at any lean angle. This is achieved by having the axes 2, 2*a* intersect the vertical middle plane in points M, M2, where the intersection points M, M2 are located on the vertical line 19 through the wheel axis 7. The vertical middle plane is defined by being perpendicular to the wheels' axes 7 and being located centrally between the two wheels 1*a*, 1*b*.

The angle beta turns out to be proportional to the angle alpha squared and proportional to the desired difference between the two curvatures, i.e. the legs' distance, and to be inversely proportional to the wheel-base. This relation can be derived easily by considering the geometry of the invented system. This invention allows many combinations of the angles alpha and beta, as required by the type of intended application.

I claim:

1. A rolling device to be used on the ground which is asymmetrically steered by leaning sideways, consisting of an upper boot or boot mounting device, a frame attached to the upper boot and at least one steering mechanism, the steering mechanism consisting of one pair of wheels oriented side by side, wherein the two wheels are rotatably affixed to two wheel holders and wherein the two wheel holders are pivotably interconnected using an upper horizontal cross-guide and a lower horizontal cross-guide so that a parallelogram or trapezium-like closed fourbar linkage results, wherein the two horizontal cross-guides are rotatably affixed each to the frame, wherein the direction of the rotation axes makes a solid angle alpha with the direction of the pivot axes of the closed fourbar linkage, wherein the two cross-guides and the frame have bore-holes which accommodate axles, bearings or spherical bushings allowing rotation around the said rotation axes, the said bore-holes being positioned so that the vertical projection of the said rotation axes onto the ground each make a solid angle beta beyond zero to the vertical projection of the pivot axes of the closed fourbar linkage onto the ground.

* * * * *